US005317151A

United States Patent [19]

Sinha et al.

[11] Patent Number: 5,317,151

[45] Date of Patent: May 31, 1994

[54] MINIATURIZED LIGHTWEIGHT MAGNETIC SECTOR FOR A FIELD-PORTABLE MASS SPECTROMETER

[76] Inventors: Mahadeva P. Sinha, 9725 Olive St., Temple City, Calif. 91780; Albert D. Tomassian, 11444 Pala Mesa Dr., Northridge, Calif. 91326

[21] Appl. No.: 969,364

[22] Filed: Oct. 30, 1992

[51] Int. Cl.[5] ..... H01J 49/30

[52] U.S. Cl. ..... 250/298; 250/396 ML

[58] Field of Search ..... 250/298, 396 ML; 335/210

[56] References Cited

U.S. PATENT DOCUMENTS

| | | | |
|---|---|---|---|
| 3,920,988 | 11/1975 | Taya et al. | 250/296 |
| 3,953,731 | 4/1976 | Forsen | 250/290 |
| 3,996,464 | 12/1976 | Fletcher et al. | 250/289 |
| 4,514,628 | 4/1985 | Frehaut et al. | 250/299 |
| 4,612,440 | 9/1986 | Brunnee et al. | 250/281 |
| 4,727,249 | 2/1988 | Bateman et al. | 250/299 |
| 4,843,239 | 6/1989 | Liebl | 250/296 |
| 4,924,090 | 5/1990 | Wollnik et al. | 250/296 |
| 5,134,287 | 7/1992 | Bateman | 250/296 |
| 5,154,978 | 10/1992 | Nakayama et al. | 428/469 |
| 5,155,357 | 10/1992 | Hemond | 250/291 |

OTHER PUBLICATIONS

Kollmann et al., Rev. Sci. Instrum., vol. 47, No. 11, Nov. 1976, pp. 1397–1398.

Blauth, *Dynamic Mass Spectrometers*, 1966, p. 7.

"Electro-Optical Ion Detectors in Mass Spectrometry Simultaneous Monitoring of All Ions over Wide Mass Ranges" authored by Heinz G. Boettger, C. E. Giffin, and D. D. Norris, published in 1979 American Chemical Society Journal, 0-8412-0504-3/79/47-102-291.

"An Electro-Optical Detector for Focal Plane Mass Spectrometers" authored by C. E. Giffin, H.G. Boettger and D. D. Norris, published in International Journal of Mass Spectrometry and Ion Physics, 15 (1974) 437–499, Elsevier Scientific Publishing Company, Amsterdam (Printed in The Netherlands).

"Development of a Miniaturized Gas Chromatograph-Mass Spectrometer with a microbore Capillary Column and an Array Detector", Analytical Chemistry, vol. 63, No. 18, Sep. 15, 1991, M. P. Sinha.

"Development of a Miniaturized, Light-Weight Magnetic Sector for a Field-Portable Mass Spectrograph", Review of Scientific Instruments, vol. 62, No. 11, Nov. 1991, M. P. Sinha et al.

*Primary Examiner*—Jack I. Berman

*Attorney, Agent, or Firm*—Oblon, Spivak, McClelland, Maier & Neustadt

[57] ABSTRACT

A magnetic sector for a non-scanning mass spectrometer includes a high permeability yoke with opposing faces to which are attached high energy product magnets and shaped pole pieces separated by a gap so that a high magnetic flux exists in the gap. The high magnetic flux in the gap enables very small surface areas of the pole pices faces forming the gap so that the overall magetic sector volume and weight are reduced.

24 Claims, 4 Drawing Sheets

MINIATURIZED LIGHTWEIGHT MAGNETIC SECTOR FOR A FIELD-PORTABLE MASS SPECTROMETER

BACKGROUND OF THE INVENTION

1. Field of the Invention

This invention relates mass spectrometers and more specifically to mass spectrometers of the non-scanning type.

2. Discussion of the Background

Mass spectrometers measure the atomic mass of ions by separating ions of different charge-to-mass ratios using a combination of an electric field and a magnetic field to bend the ions proportional to their charge-to-mass ratio. Previous mass spectrometers have been large and heavy, typically over 1,000 lbs., because of their requirements for a very high pumping speed in order to differentially pump an ionizing region. The ionizing region generates ions of the molecules to be measured in a mass spectrometer detection region and generates an ion beam comprised of those molecules for transmission of the ions to the detection region. The ion beam must have a very low density so that ions in the ion beam do not collide with one another thereby perturbing their trajectories. Furthermore, the initial ion beam trajectories must be highly collimated so that they do not collide with walls along the ion beam path and so that the ions can be mass separated.

Prior mass spectrographs were also large because their magnetic sectors were designed to widely spatially separate ions of different masses in order to analyze those masses. In particular, the magnetic sectors used large magnets or electromagnets.

In other prior devices the ion trajectories were changed such that ions of only one mass to charge ratio passed through a fixed slit and their flux was measured by a detector located downstream from the slit. The fluxes of different mass ions were thus measured in succession. A mass spectrometer using a single slit is called a scanning mass spectrometer.

In a non-scanning mass spectrometer, ions of different masses are spatially separated and can be measured simultaneously. Consequently, a non-scanning mass spectrometer possesses a higher sensitivity and is capable of a higher data acquisition rate than a scanning mass spectrometer.

It has been found very useful to combine gas chromatography as a means for separating components of a mixture of gases prior to their introduction into an ion source of a mass spectrometer. This has been accomplished by providing a relatively long gas chromatographic column on the order of 30 meters whose input end receives gases whose mass spectra are to be determined and whose output end expels gases separated in time into an ionization chamber. Such an instrument is called a GC-MS. A 30 meter long gas chromatography tube has been required because standard tubes which have inner diameters of greater than 200 microns and therefore require a relatively long time to perform their component separation function. A gas chromatographic tube separates a mixture of multiple gases flowing down the tube into single components which exit from the tube at different times. Separation of components by chromatography makes the measurement of their individual mass spectra simpler. Because of the length and rather large inner diameter of gas chromatography tubes, the duration of exit of any given bunch of similar molecules from these tubes has been rather long, typically on the order of a few seconds. Because of the large tube diameter, a relatively large volume of gas flows through these tubes, typically 2 to 5 atm $cm^3$ per minute. The large volume of gas flowing through these tubes requires a very large pump at or past the ionization chamber in order to provide the very low pressure and density necessary for an ion beam for a mass spectrometer.

It has been demonstrated that microbore capillary tubes, i.e., capillary tubes whose inner diameter is less than 100 microns, may be advantageously used in gas chromatography. These tubes greatly reduce the volume of gas flowing through them while providing the necessary separation of different types of molecules flowing through them. For example, a 50 micron inner diameter, 3 meter long microbore tube has a gas flow rate of 0.02 atm $cm^3$ per minute. Because of the reduced gas load the size and weight of vacuum pumps necessary to reduce the pressure to that suitable for mass spectrometry is greatly reduced. Pumps weighing less than 20 pounds are adequate. However, molecules of a similar type exit a microbore capillary gas chromatography tube in a much reduced time period compared to normal GC tubes. Molecules of a similar type typically exit a microbore gas chromatography tube in a time period of a fraction of a second. When a microbore capillary gas chromatography tube is hooked up to a scanning mass spectrometer to form a GC-MS, ions generated from one type of molecule impinge upon the image plane of a mass spectrometer for a period of time approximately equal to the time period during which those ions exit the microbore capillary tube, i.e., a fraction of a second. Unless such a scanning mass spectrometer scans its entire mass detection range in a time faster than the duration of a pulse of ions exiting a microbore tube, those ions may remain undetected by the mass spectrometer. Furthermore, multiple mass spectral scans must be made in this brief period for the components to be quantified.

To solve this problem, it has been shown that a microbore capillary tube may be used to provide source gas to a non-scanning mass spectrometer. A non-scanning mass spectrometer functions by simultaneously detecting ions along the length of an image plane in order to simultaneously determine the content of the ion beam for ions of different masses.

Existing non-scanning mass spectrometers typically weigh at least several hundred pounds because of the high pumping requirements requiring large pumps to provide high pumping capacity and because of the large magnets used in the magnetic sectors of these devices. Therefore, these devices are unsuitable for routine transportation or for routine field testing. Existing non-scanning mass spectrometers have had magnetic flux densities in the gap between their pole pieces of 10 kilogauss or less. However, the 10 kilogauss values achieved by prior non-scanning devices required very thick magnets and very thick yokes to conduct sufficient magnetic flux. Prior non-scanning devices used magnetic materials having energy products of below $7\times10^6$ GOe.

SUMMARY OF THE INVENTION

Accordingly, an object of the present invention is to provide a new and improved magnetic sector of a mass spectrograph for use with a gas input source comprising a microbore capillary gas chromatography.

Another object of the present invention is to provide a gas chromatograph mass spectrograph (GC-MS) which is light enough so that it may be conveniently transported to field sites such as industrial work places and environmental waste sites in order to determine environmental content of particular molecules at those sites.

A further object of the invention is to provide a GC-MS that is particularly suited for determination of those organic chemicals which are most often found as environmental pollutants and which all have molecular weights in the range of 40–240 atomic mass units (AMU).

These and other objects are accomplished by the present invention by providing a new magnetic sector design for a non-scanning mass spectrometer including magnets made of ultra-high energy product magnetic material, a yoke having a high magnetic permeability material, and novel pole pieces designed to concentrate the field produced by the magnetic sector to only that region necessary for mass analysis, in order to reduce the magnetic sector weight and volume. Field concentration is accomplished by tapering the edges of the pole pieces and by designing the opposing surfaces of the pole pieces so that the pole pieces enclose between them only that region through which ions in the range of 40–240 AMU traverse, plus necessary tolerances on either side of the ion trajectories in order to avoid magnetic field non-uniformities at positions along any of the trajectories. Unprecedented magnetic flux densities of 11 kilogauss have been achieved thereby enabling drastically reduced pole piece surface area. The specific structure and orientation of the pole pieces relative to the rest of the magnetic sector and to a GC-MS are illustrated in the appended drawings and discussed further herein.

Because of the novel features of the present invention, a GC-MS using a microbore gas chromatograph tube may be fabricated with a total weight of less than 80 lbs, including pump weight. This GC-MS has a greatly improved sensitivity over known mass spectrographs due to the microbore GC input and non-scanning features. The microbore input provides separated component peaks for detection by the non-scanning mass spectrometer. Furthermore, since this instrument is portable, it allows actual field testing in industrial work places and at environmental sites for determination of pollutants.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
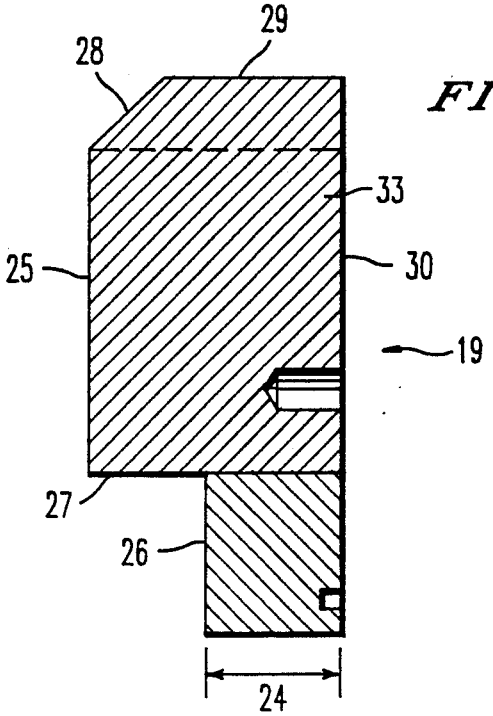
FIG. 1 is a side view of a top pole piece of a magnetic sector.
Figure 2:
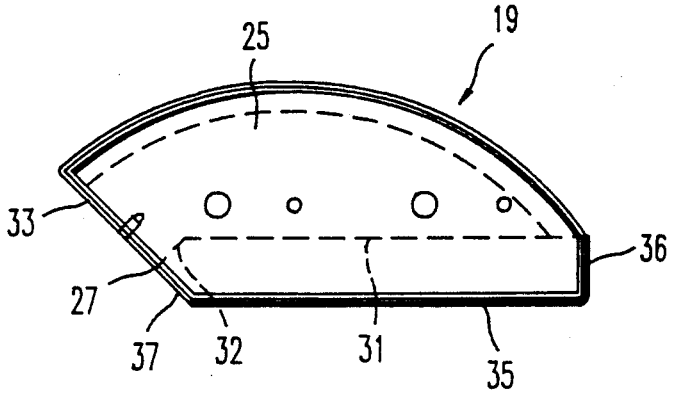
FIG. 2 is a bottom view of the top pole piece of FIG. 1.
Figure 3:
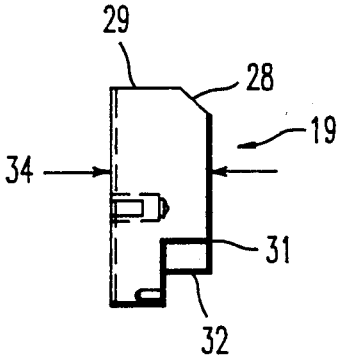
FIG. 3 is another side view of the top pole piece of FIG. 1.
Figure 4:
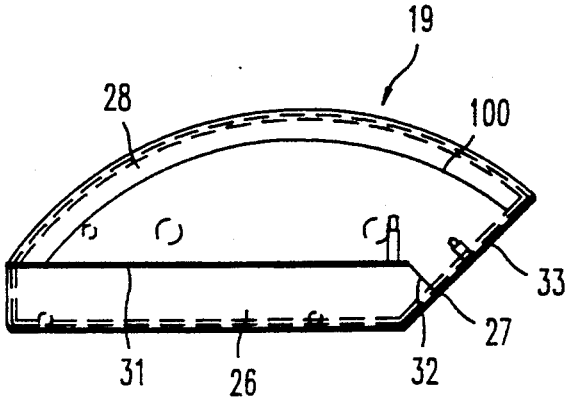
FIG. 4 is a top view of the top pole piece of FIG. 1.
Figure 13:
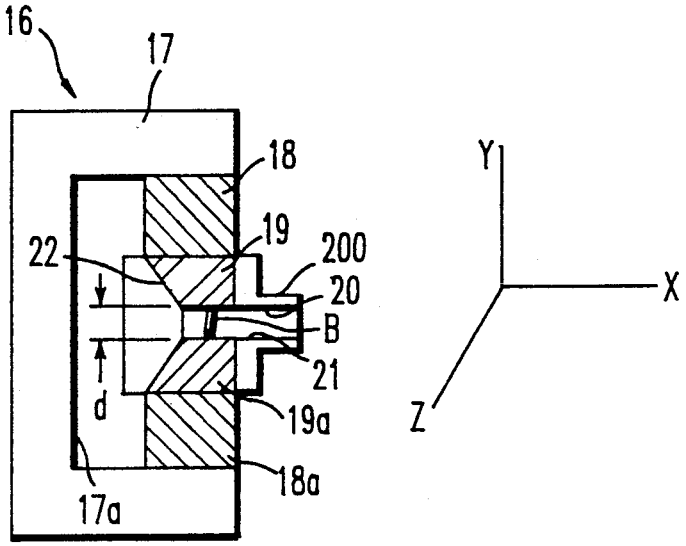
FIG. 13 is a side view, partly in cross section of an assembled magnetic sector including two magnetic pole pieces, two magnets, a yoke, and a vacuum enclosure.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 13 schematically shows a magnetic sector for a mass spectrometer of the present invention. The magnetic sector consists of a yoke 17, upper magnet 18 and upper pole piece 19, and a lower magnet **18*a* and low pole piece 19*a*. Upper pole piece 19 has a tapered surface 22 the function of which is to concentrate the field lines emanating from the upper magnet 18 to provide a strong magnetic field in the region between lower surface 20 of the upper pole piece 19 and upper surface 21 of the lower pole piece 19*a*. In practice, trajectories of ions from an ion beam of a mass spectrometer enter the magnetic sector 16 along a trajectory which is vertical to the plane shown for the magnetic sector, i.e., along the z direction shown in FIG. 13 and in a region centered between the two pole piece surfaces 20, 21. The cross section B, which is in the x-y plane, of the ion beam entering the magnetic sector extends the length d along the y direction between the pole faces 20, 21 and is much more narrow in the horizontal x direction for reasons discussed further herein. Pole pieces 19, 19*a* have their side surfaces enclosed in vacuum enclosure 200 the function of which is to seal the pole pieces so that the pole pieces can be vacuum connected to electric sector 6 without having to include the rest of magnetic sector 16** in a vacuum enclosure.

Figure 14:
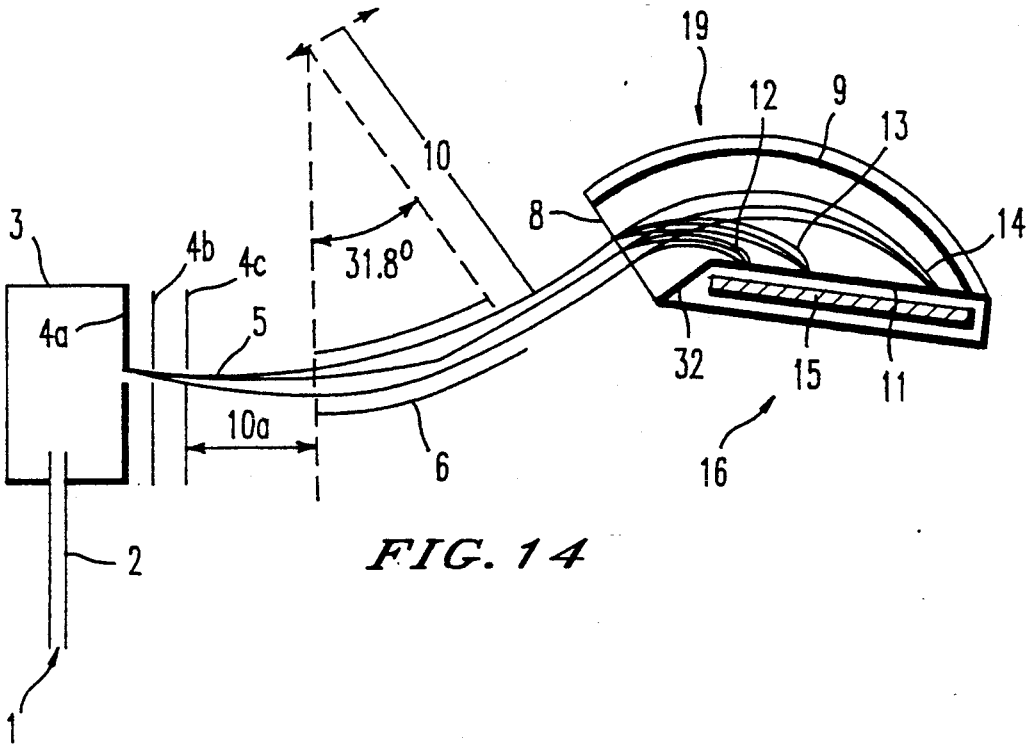
FIG. 14 is a schematic illustration of the operation and structure of a GC-MS in a Mattauch-Herzog mass spectrometer.

FIG. 14 shows a side sectional view of a mass spectrograph in order to show the path of molecules and ions to be tested by the mass spectrometer. Gases 1 containing molecules or atoms whose masses are desired to be known enter a microbore gas chromatographic column 2 and exit that tube in an ionization chamber 3. Ionization chamber 3 ionizes gases therein. Ions are extracted from the ionization chamber 3 and passed through a series of collimation and focusing slits **4*a*, 4*b* and 4*c* to form ion beam 5 whose ions exit the ionization chamber along trajectories directed towards electric sector 6. To satisfy the Mattauch-Herzog conditions, the distance 10*a* from the ionization chamber slits 4*a*, 4*b*, 4*c*, to the entrance face of the electric sector 6 is equal to a radius of curvature 10 of the electric sector, and the electric sector includes a 31.8 degree angle. Satisying the Mattauch-Herzog conditions eliminates velocity dispersion at image plane 11. Ion beam 5 passes through electric sector 6 and is bent thereby due to an electric field present in the electric sector 6. The ion beam 5 exits electric sector 6 and enters the magnetic field region between two opposing pole pieces of a magnetic sector, such as the magnetic sector 16 shown schematically in FIG. 13. The two opposing pole piece surfaces delimit a uniform magnetic field region through which ion beam 5 passes after leaving the electric sector 6. Ion beam 5 passes into the high magnetic field region at magnetic sector entrance plane 8. Because the ions have different masses, their radius of curvature in the magnetic field and the region between the two opposed pole face surfaces of the magnetic sector 16** vary.

FIG. 14 shows trajectories 12, 13 and 14 which correspond, respectively, to a lowest mass ion trajectories, an intermediate mass ion trajectories and a highest mass ion trajectories to be measured by the present invention. The lowest mass ions are 40 AMU and the highest mass ions are approximately 240 AMU. The limitations on the mass detection range are directly a function of the magnetic field in the region between the pole pieces, the length of the entrance plane 8 of the magnetic sector, the length of the image plane 11 of the magnetic sector, the curvature of the arcuate outer edge 9 of the pole face, and the energy of the ions emerging from the ion chamber 3. The mass detection range may be varied by changing the ion acceleration potential in the ion chamber. The preferred embodiment has a mass detection range of 40 to 240 AMU for an ion acceleration potential of 1.0 KeV. Variation of the acceleration potential shifts the mass range which can be detected by modifying the radii of curvature of trajectories of ions in the magnetic sector. Therefore, variations of acceleration potential of up to 20 percent are acceptable for the preferred embodiment.

If angled surface 32 is too long, it may block some of the trajectories for the lighter mass ions. The ion trajectories end at the magnetic sector image plane 11 where the ions impinge upon a spatial multichannel detector 15. Spatial multichannel detector 15 determine the number of ions impinging at each of the locations where ion trajectories impinge upon detector 15. The positional dependence of ions along detector 15 is a direct function of the mass of those ions.

The present magnetic sector has been designed in accordance with the Mattauch-Herzog geometry. The Mattauch-Herzog geometry eliminates velocity dependence so that the final position of ions along the magnetic sector image plane is a measure of only their mass. This is accomplished through appropriate selection of an electric sector bend angle of 31.8° and appropriate positioning of the electric sector relative to an object slit of the ionization chamber 3 so that the trajectories of ions of ion beam 5 exiting the electric sector 6 form a bundle of parallel rays. The ion beam enters the magnetic sector at right angles to the entrance plane 8. Furthermore, the Mattauch-Herzog geometry provides that magnetic sector image plane 11 be at a 45° angle with respect to entrance plane 8 of the magnetic sector. When such geometric relationships are satisfied between the electric sector and the magnetic sector, the final position of ions along the magnetic sector image plane is a function solely of the mass of those ions. The ions of different masses are separated along the image plane 11 and are velocity and direction focused to the first order for all masses along the entire magnetic sector focal plane which coincides with image plane 11. The ion trajectories rotate by 90 degrees while in the magnetic field of magnetic sector 16.

FIG. 13 shows a distance d between the opposing faces of the pole pieces of the magnetic sector. Distance d should be larger than the object height and larger than the image height based upon sensitivity considerations. However d can not be made arbitrarily large because the area and thickness of the pole pieces and magnets of the magnetic sector 16 must increase as the distance d increases. Also, the larger the spatial extent, the larger the non-uniform fringing magnetic fields in the regions between the opposing surfaces 20 and 21 of the pole pieces. The fringing fields are due to the limited lateral spatial extent of pole piece faces 20, 21. The fringing fields provide non-parallel magnetic flux lines and also have a magnetic field strength which varies with position. Since non-uniform magnetic fields are extremely detrimental to the present invention, they must be avoided at all costs.

Typical cross-sections of the ion beam 5 are 0.001 inches by 0.10 inches as it leaves the ion chamber slits 4*a*, 4*b*, 4*c*. The longer direction, i.e., 0.10 inches extends in a direction perpendicular to the opposing surfaces 20 and 21 of the pole pieces. The pole face separation d has been kept at 0.15 inches so that only the central uniform magnetic field region is exposed to the ion beam and accommodates any divergence in the x direction. The longer direction of the ion beam is, therefore, bounded by the opposing pole piece surfaces 20, 21 in the region in the magnetic sector. The longer the long direction of the ion beam, the greater will be a mass spectrometer signal obtained, due to the increased number of ions. However, opposing pole piece faces 20, 21 must be close together in order to reduce fringing fields at the edges thereof. Furthermore, there is some trajectory dispersion along the long direction of the ion beams so that the ion beam fans out along its long direction. Therefore the gap spacing d cannot be made arbitrarily small while still maintaining a mass spectroscopy signal of adequate intensity at the image plane of the magnetic sector.

The short direction of the ion beam 5, i.e., that direction along which the ion beam is approximately 0.001 inches, determines the ultimate mass resolution obtained by the magnetic sector, because spread in the short direction of the ion beam corresponds to overlap of ions of different molecular masses at the image plane of the magnetic sector. Thus, the signal may not be increased by increasing the width of the short direction of the ion beam. Based upon these considerations and the desired goal of an extremely light weight mass spectrometer, the structural features of the pole pieces in conjunction with high energy product magnetic alloy Crumax 355 for corresponding magnets was determined. Crumax is an Nd-B-Fe alloy which may be obtained from Crucible Magnetics, Elizabethtown, Ky.

The structure of the preferred embodiment for a top pole piece of a magnetic sector of the present invention will now be described with reference to FIGS. 1–4. FIG. 1 shows a side view of a top pole piece have a lip 24 adjacent to a recessed surface 26. Recessed surface 26 is more clearly seen in FIG. 4 which shows that recessed surface 26 is adjacent to the length of image plane surface 31. Image plane surface 31 is in the image plane of the magnetic sector. Image plane surface 31 extends from angled surface 32, which is at a low mass end of the image plane surface 31 to arcuate taper 28 and to arcuate side surface 29 at a high mass end of image plane 31. Thickness 34 shown in FIG. 3 encompasses the thickness of top pole piece 19 between arcuate side surface 29 and arcuate taper 28 and encompass the region between lower opposing surface 25 which opposes upper surface 30 of the lower pole piece. Arcuate taper 28 intersects lower surface 20 at arcuate edge 100. Ion trajectories are intended to enter the magnetic sector in the centered region between entrance plane surface 33 of the upper pole piece and the corresponding entrance plane surface of the lower pole piece. Image plane surface 31 is aligned so that if it were extended it would intersect the center of entrance plane surface 33 at the centered region thereof that is intended to receive an ion beam. Furthermore, the image plane is at a 45° angle with respect to the entrance plane surface as required by the Mattauch-Herzog conditions. The upper and lower pole pieces are both made from cold rolled steel which has a high magnetic permeability so that it may contain and focus magnetic field lines entering the cold rolled steel. As shown in FIG. 13, upper pole piece 19 connects to high energy product magnetic 18. The lines of force from high energy product magnet 18 passed down through upper pole piece 19 are focused therein so that they exit the reduced area of upper pole piece lower surface 20 and then traverse the gap region between the upper pole piece 19 and lower pole piece 19*a* and enter the lower pole piece 19*a* through lower pole piece upper surface 21. As shown in FIG. 13, the entrance plane surfaces of the pole pieces 19, 19*a* are in the plane of the paper. Side surface 35 connects a side of the upper pole piece between distal surface 36 and an extension 37 of the entrance plane surface 33. Arcuate side surface 29 intersects entrance plane surface 33 at a 90° angle.

In the preferred embodiment the upper pole piece has the following dimensions. Lip 24 is 0.515 inches. Thickness 34 is 0.94 inches. The longest perpendicular distance from the magnetic sector image plane surface 31 to the furthest point along arcuate side surface 29 is 1.448 inches. The radius of curvature of arcuate side surface 29 is 3.38 inches. Arcuate taper 28 is at a 45° angle with respect to arcuate side surface 29 and with respect to lower opposing surface 25. Recessed surface 26 projects a distance 0.6 inches from image plane surface 31. Angled surface 32 is perpendicular to image plane surface 31. Edge 100 has a radius of curvature of 3.1 inches. The total surface area of each opposing pole piece face 20, 21 is 3.6 square inches.

In practice, upper pole piece 19 is disposed in the magnetic sector so as to oppose lower pole piece 19*a*. The distance between the upper and lower pole pieces is preferably 0.15 inches, but may vary from 0.14 to 0.16 inches and still be useful for the disclosed upper pole piece size discussed above. The upper pole piece dimensions discussed above are designed with the following constraints in mind. First, the ion entrance plane surface 33 must extend at least 2, and preferably 3 times the distance d from either side of the ion beam so that the magnetic field at the entrance plane 33 in the vicinity of the ion beam is uniform. If this constraint is not met then a non-uniform magnetic field will exist at the entrance plane of the magnetic sector and the magnetic sector will not properly focus ions according to their mass at the image plane and the ions might collide with the pole pieces. Arcuate edge 100 of the upper pole piece lower surface along where the arcuate taper 28 meets lower surface 20 of the upper pole piece must be large enough so that no ion trajectories for those ions to be measured is within twice the distance d from arcuate edge 100 in order to avoid fringing magnetic field perturbations on the ion trajectories. The dimensions discussed above for the preferred embodiment of the upper pole piece satisfy these conditions.

While exact dimensions have been given above, deviations of up to 15% from those dimensions are acceptable and will still provide focusing in the image plane of the magnetic sector according to mass. Furthermore, it should be clear that any larger curvature for arcuate edge 100 and concomitant longer image plane surface length will provide an increased range of masses which may be analyzed. However, such increases entail additional size and weight in the pole piece and the corresponding magnetic sector. The pole pieces are preferably made of cold rolled steel.

FIGS. 5–8 show a pole piece structure for the preferred embodiment for a lower pole piece 19*a*. It should be noted that one difference between the upper pole piece 19 and the lower pole piece 19*a* is that the lower pole piece is missing any feature corresponding to lip 24. The purpose of the lip is to correct the flux direction so that array detector 15 can function in the fringe field region, i.e., outside the region enclosed by the pole piece faces 20, 21. In addition arcuate taper 46 and radius of curvature for arcuate side surface 44 of lower pole piece 19*a* are different than for corresponding features of upper pole piece 19, as discussed below.

Figure 5:
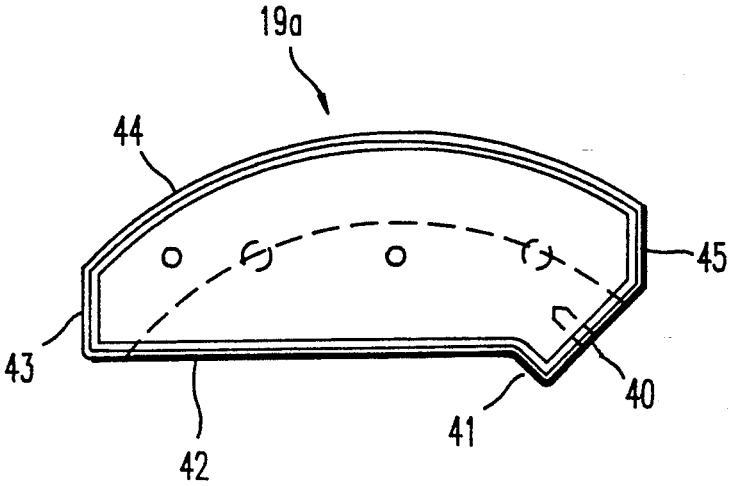
FIG. 5 is a bottom view of a bottom pole piece for the same magnetic sector as the top pole piece of FIG. 1.
Figure 6:
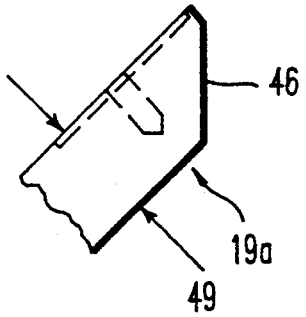
FIG. 6 is a side view of the bottom pole piece of FIG. 5.
Figure 7:
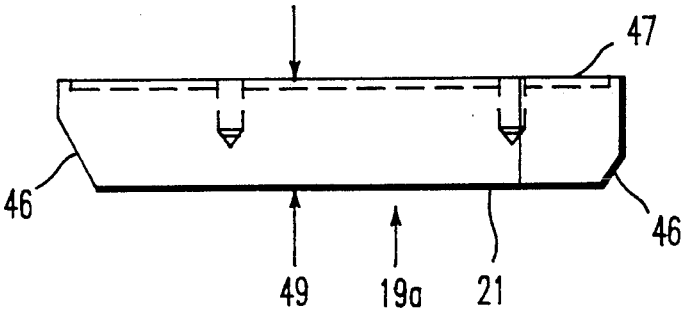
FIG. 7 is another side view of the bottom pole piece of FIG. 5.
Figure 8:
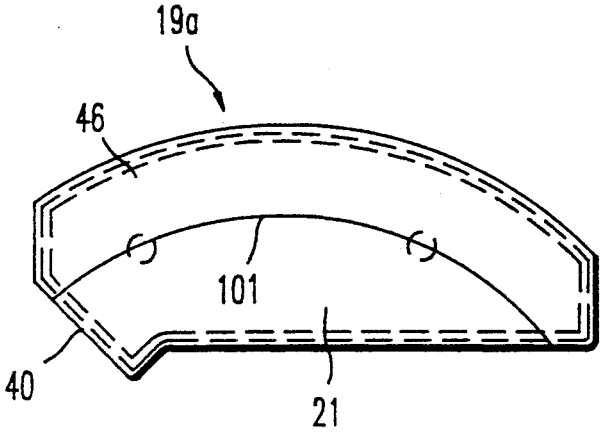
FIG. 8 is a top view of the bottom pole piece of FIG. 5.

Referring now to FIGS. 5–8 which show different orientations of lower pole piece 19*a* of the preferred embodiment, is shown an entrance plane surface 40 above which an ion beam passes at a direction which is perpendicular to the entrance plane surface. Entrance plane surface 40 connects to proximate end surface 45 of lower pole piece 19*a*. Proximate end surface 45 is at a 45° angle relative to the entrance plane surface 40. Entrance plane surface 40 is also connected at an edge thereof to angled surface 41 as shown in FIG. 5. Image plane surface 42 extends at a 45° angle relative to entrance plane surface 40 and, if extended, would intersect the entrance plane surface 40 at a centered point thereof. It is intended that an ion beam pass between the center of the entrance plane surfaces for pole pieces 19 and 19*a*. Image plane surface 42 is connected to, and at right angles with, distal end surface 43. Distal end surface 43 and proximate end surface 45 are connected through arcuate side surface 44. Arcuate side surface 44 connects to upper surface 21 as shown in FIG. 7 via arcuate taper 46. Arcuate taper 46 intersects upper surface 21 at arcuate edge 101. Arcuate taper 46 is preferably at a 45° angle relative to both upper surface 21 and arcuate side surface 44. The lower pole piece 19*a* has a thickness between upper surface 21 and lower surface 47 indicated by 49.

Lower pole piece 19*a* is formed from cold rolled steel which has a high magnetic permeability so that it can conduct and concentrate magnetic lines of force so that they exit through and perpendicular to upper surface 21. Arcuate side surface 44 forms an arc which, if extended, would perpendicularly intersect the plane containing entrance plane surface 40.

The preferred embodiment has the following dimensions for the features discussed above. However, these preferred features may be varied by approximately 15%, unless otherwise specified, while still retaining utility of the lower pole piece. Proximate end surface 45 is parallel to distal end surface 43 and spaced therefrom by 4.98 inches. A maximum distance from image plane surface 42 along a perpendicular from image plane surface 42 to a furthest point along arcuate side surface 44 is 1.948 inches. Image plane surface 44 is disposed at a 45° angle relative to entrance plane surface 40 and angled surface 41 is perpendicular to entrance plane surface 40. Thickness 49 is 0.94 inches. Arcuate side surface 44 has a radius of curvature of 3.88 inches. However, the radius of curvature of arcuate edge 101 is 3.1 inches. Distal end surface 43 is 0.78 inches long in its extension between arcuate side surface 44 and image plane surface 42. Arcuate taper 46 is at a 45° angle from arcuate side surface 44 as well as from upper surface 21.

Also shown in the figures but unlabelled are positions for through holes necessary to connect the pole pieces to the remainder of the magnetic sector.

It should be noted that both of the opposing surfaces, 20 and 21, of the pole pieces have the same radii of curvature, of 3.1 inches. In this regard, only the outer radius of the arcuate side surfaces 29 and 44 and the corresponding tapers differ between the upper and lower pole pieces.

As discussed above, the angle between the entrance plane and the image plane is of critical importance since it is necessary to maintain the Mattauch-Herzog relationship which provides velocity independence of the spatial distribution of the ions at the image plane of the magnetic sector. The separation between the pole pieces and the relations between that separation and the size of the entrance plane, image plane, and arcuate side surface have already been discussed above with regards to the upper pole piece.

The pole pieces are each connected to a high energy product magnet. The magnetic material used in these magnets is CRUMAX 355. CRUMAX 355 has an energy product value of $17\times10^6$ GOe at a magnetic flux density of 10.7 kilogauss and a maximum energy product of $35\times10^6$ GOe. CRUMAX 355 may be obtained from Crucible Magnetics Corporation in Elizabeth Town, Ky. The required volume and the weight of the magnets are inversely proportional to their energy product value at the operating magnetic flux density.

Figure 9:
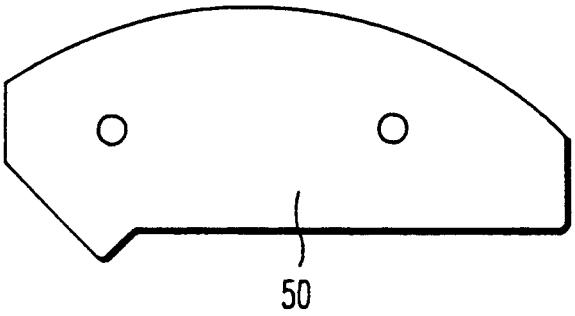
FIG. 9 is a top view of a bottom magnet for the same magnetic sector as the top pole piece of FIG. 1.

FIG. 9 shows a top view of a bottom magnet which connects to the bottom pole piece of the magnetic sector through upper surface 50. Top surface 50 has the same dimensions as lower surface 47 of the lower pole piece to which it connects. In the preferred embodiment, connections are made through use of screws which pass through yoke 17, magnet 18, and secure in lower pole piece 19*a*. In addition, the pole pieces are enclosed in a stainless steel vacuum enclosure 200. The stainless steel enclosure encloses side surfaces of the pole pieces and is welded to the pole pieces near where the pole pieces attach to the magnets. The function of the stainless steel enclosure is to provide a vacuum between the pole pieces and to provide vacuum plumbing which connects to a vacuum in the electric sector. The enclosure allows the magnets and the yoke to be outside of vacuum.

Figure 10:
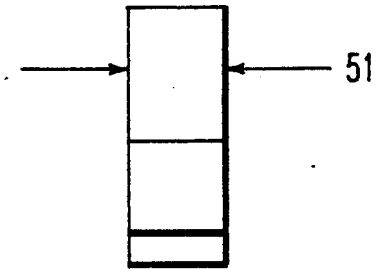
FIG. 10 is a side view of the magnet shown in FIG. 9.

Upper pole piece 19 and bottom surface 47 of bottom pole piece 19*a* are disposed in a stainless steel enclosure. Screw holes are shown but unlabelled in the figures. Lower magnet 18*a* has a thickness 51 which is 0.75 inches in the preferred embodiment, as shown in FIG. 10. The upper and lower surface of lower magnet 18*a* are parallel to one another.

Figure 11:
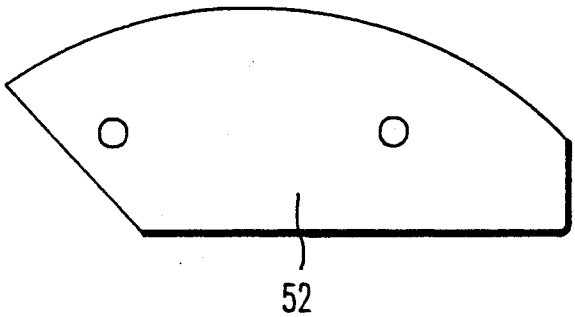
FIG. 11 is a top view of a top magnet for the same magnetic sector as the top pole piece of FIG. 1.
Figure 12:
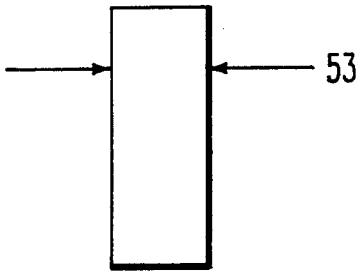
FIG. 12 is a side view of the magnet of FIG. 11.

In a similar fashion upper magnet 18, as shown in FIGS. 11 and 12, has the same side dimensions as the upper portion of upper pole piece 19. Because the magnets are formed in the same shape as the portions of the pole pieces to which they connect, the vast majority of magnetic flux provided by these magnets is contained within the magnetic pole pieces and within the remaining portions of the magnetic circuit formed by yoke 17. Screw holes which are shown but not labelled in FIGS. 9–12, indicate a means for connection of the magnets to the pole pieces and to the yoke 17. Upper magnet 18 has a thickness 53 of 0.75 inches in the preferred embodiment.

In order to complete a magnetic circuit, magnetic sector 16 must include yoke 17. The constraints on yoke 17 are that it should be wide enough along the z direction and the x direction to overlap all of the surface area of the magnets, it should be fabricated from a very high magnetic flux permeability material. The first constraint minimizes the flux loss and the second constraint determines the minimum thickness and weight of the yoke. Because weight of the yoke is therefore tied to the surface area in the x-z plane for the magnets it is very desirable to minimize the magnet surface area in the x-z plane. Another constraint placed upon yoke 17 is that the separation distance between rear portion 17*a* of the magnetic yoke 17 and the high energy product magnets is great enough so that not too much magnetic flux leaks out of the circuit. In order to satisfy this condition the separation between the magnets and the rear portion 17*a* of the magnetic sector must be on the order of the dimensions of the magnets 18, 18*a*. Yoke 17 comprises an alloy of V-Co-Fe which is commercially known as HIPERCO-50A. This alloy can conduct a magnetic flux density up to 24 kilogauss per square centimeter because of its high magnetic permeability.

Based upon the aforementioned design a magnetic sector, including yoke 17, magnets 18, 18*a*, pole pieces, and a vacuum enclosure for the pole pieces has been fabricated which weighs only 24 pounds as compared with typical prior art magnetic sectors which weigh more than one hundred pounds. This has been made possible by the high energy product magnets, high permeability yoke material and the novel pole piece design. In particular the arcuate tapers of the pole pieces concentrate the magnetic field so that a magnetic flux density of 11 kilogauss is provided between pole piece faces 20, 21. Prior magnetic sectors have only achieved 10.0 Kilogauss or less flux density between their pole pieces. Because of the increased flux density provided by the present design, it has been possible to reduce the pole piece surfaces 20, 21 areas to less than 6 square inches each. Since the mass of the magnetic sector of a mass spectrometer varies monotonically with pole piece surface area it is advantageous to reduce the cross sectional area of the pole piece surfaces 20, 21 as much as possible. Therefore a pole piece surface area for each pole piece surface 20, 21 of 4 square inches is preferable to 5 square inches and 5 square inches is preferable to 6 square inches.

Obviously, numerous modifications and variations of the present invention are possible in light of the above teachings. It is therefore to be understood that within the scope of the pending claims, the invention may be practiced otherwise than as specifically described herein.

What is claimed as new and desired to secured by Letters Patent in the United States is:

1. A magnetic sector for a double focusing non-scanning mass spectrometer, comprising:

a yoke of high magnetic permeability material for guiding magnetic flux therethrough, said yoke having a yoke upper surface and a yoke lower surface opposing the yoke upper surface;

an upper magnet comprising magnetic material which has an energy product density of greater than $1\times10^7$ GOe and having an upper magnet upper surface and an upper magnet lower surface, said upper magnet upper surface connected to and magnetically coupled with the yoke upper surface;

a lower magnet comprising magnetic material which has an energy product density of greater than $1\times10^7$ GOe and having a lower magnet lower surface and a lower magnet upper surface, said lower magnet lower surface attached to and magnetically coupled with the yoke lower surface;

an upper pole piece having an upper pole piece upper surface and an upper pole piece lower surface, said upper pole piece upper surface connected to said upper magnet lower surface, said upper pole piece upper surface having the same shape and size as the upper magnet lower surface and attached to and aligned therewith;

a lower pole piece having a lower pole piece lower surface and a lower pole piece upper surface, said lower pole piece lower surface connected to said lower magnet upper surface, said lower pole piece lower surface having the same size and shape as said lower magnet upper surface and attached to and aligned therewith;

wherein the upper pole piece lower surface and the lower pole piece upper surface both have the same shape, are both flat, in parallel, and aligned with one another; and wherein the upper pole piece has a different shape than the lower pole piece.

2. A magnetic sector according to claim 1, wherein:

the surface area of each of said upper pole piece lower surface and said lower pole piece upper surface is less than 6 square inches.

3. A magnetic sector according to claim 1, wherein:

the surface area of each of said upper pole piece lower surface and said lower pole piece upper surface is less than 4 square inches.

4. A magnetic sector according to claim 1, wherein:

the surface area of each of said upper pole piece lower surface and said lower pole piece upper surface is about 3.6 square inches.

5. A magnetic sector according to claim 1, wherein:

a magnetic flux density between said flat upper pole piece lower surface and said lower pole piece upper surface is greater than 10.1 kilogauss.

6. A magnetic sector according to claim 1, wherein:

a magnetic flux density between said upper pole piece lower surface and said lower pole piece upper surface is greater than 10.5 kilogauss.

7. A magnetic sector according to claim 1, wherein:

a magnetic flux density between said flat upper pole piece lower surface and said flat lower pole piece upper surface is about 11 kilogauss.

8. A magnetic sector according to claim 1, wherein:

the upper pole piece further comprises an upper pole piece arcuate side surface and an upper pole piece arcuate taper connecting the upper pole piece arcuate side surface to said upper pole piece lower surface; and the lower pole piece further comprises a lower pole piece arcuate side surface and a lower pole piece arcuate taper connecting the lower pole piece arcuate side surface to said lower pole piece upper surface.

9. A magnetic sector according to claim 8, wherein:

the upper pole piece arcuate taper and the lower pole piece arcuate taper are slanted at a taper angle of less than 50 degrees relative to a normal to the upper pole piece lower surface.

10. A magnetic sector according to claim 9, wherein:

said taper angle is about 45 degrees.

11. A magnetic sector according to claim 8, wherein:

a lower pole piece arcuate edge formed by the intersection of the lower pole piece arcuate taper with the lower pole piece upper surface has a radius of curvature of about 3.1 inches.

12. A magnetic sector according to claim 1, wherein:

a gap distance between said lower pole piece upper surface and said upper surface lower pole piece is about 0.15 inches.

13. A magnetic sector according to claim 8, wherein:

said lower pole piece further comprises a lower pole piece entrance side surface above which an ion beam is intended to pass, said lower pole piece entrance side surface intersects said arcuate side surface at a right angle, intersects said lower pole piece upper surface at a right angle, and has an entrance side surface length along said lower pole piece upper surface.

14. A magnetic sector according to claim 13, wherein:

a gap distance separates the lower pole piece upper surface from the upper pole piece lower surface and said entrance side surface length is at least 4 times said gap distance.

15. A magnetic sector according to claim 14, wherein:

said lower pole piece further comprises an image plane side surface located in a plane containing an image plane of the magnetic sector which is at a 45 degree angle relative to the entrance side surface, said image plane side surface connects to said lower pole piece upper surface at an image plane edge and said image plane edge is about 2 inches long.

16. A magnetic sector according to claim 15 wherein:

a thickness of said lower pole piece between the lower pole piece lower surface and the lower pole piece upper surface is about 0.94 inches.

17. A magnetic sector according to claim 1, wherein:

said upper magnet and said lower magnet comprise Nd-Fe-B magnetic material which has an energy product greater than $34\times10^6$ GOe.

18. A magnetic sector according to claim 1, wherein:

said upper magnet and said lower magnet have a thickness of about 0.75 inches.

19. A magnetic sector according to claim 1, further comprising:

a vacuum housing welded to the pole pieces; and wherein said magnetic sector weighs less than 50 pounds.

20. A magnetic sector according to claim 19, wherein:

said magnetic sector weighs about 24 pounds.

21. A magnetic sector according to claim 1, wherein:

said yoke has a magnetic permeability of greater than 20 kilogauss per square centimeter.

22. A magnetic sector according to claim 1, wherein said upper pole piece lower surface has as an image plane edge along an image plane of the mass spectrometer, said upper pole piece further comprising;

a recessed surface that is parallel to said upper pole piece lower surface and recessed therefrom, said recessed surface having an image plane edge that is along said image plane, the image plane edge of the upper pole piece lower surface and the image plane edge of said recessed surface are spaced from one another except by a distance that the recessed surface is recessed from said upper pole piece lower surface; and wherein said lower pole piece upper surface and said lower pole piece lower surface have edges along the image plane and said lower pole piece has a side surface that is in the image plane and that is formed by all of the region of the image plane that is between the edges of the lower pole piece upper surface and the lower pole piece lower surface that are along the image plane.

23. A magnetic sector according to claim 22, wherein:

the upper pole piece further comprises an upper pole piece entrance plane surface that is in an entrance plane of the magnetic sector and that is at a 45° angle relative to the image plane, said upper pole piece entrance plane is bounded from above and from below by the upper pole piece upper surface and the upper pole piece lower surface, a first side end of the upper pole piece entrance plane surface contacting edges of the recessed surface and a second side end of the upper pole piece entrance plane surface that is opposite the first end of the upper pole piece entrance plane surface contacting an arcuate taper and an arcuate side of the upper pole piece, both the arcuate taper and the arcuate side of the upper pole piece are perpendicular to the upper pole piece entrance plane surface at the points where they contact the upper pole piece entrance plane surface; and wherein the lower pole piece further comprises a lower pole piece entrance plane surface that is in the entrance plane, said lower pole piece entrance plane surface having upper and lower edges that are adjacent to the lower pole piece upper surface and the lower pole piece lower surface and a side edge contacting a lower pole piece first side surface, said lower pole piece first side surface is in a plane that is at a 45° angle relative to the entrance plane and a 90° angle relative to the image plane;

wherein the shape of the upper pole piece entrance plane surface and the shape of the lower pole piece entrance plane surface are different from one another.

24. A magnetic sector according to claim 1, wherein:

the upper pole piece and the lower pole piece are shaped to provide a uniform magnetic field region between them.

* * * * *